US005339540A

United States Patent [19]

Edwards

[11] Patent Number: 5,339,540

[45] Date of Patent: Aug. 23, 1994

[54] HAIR DRYER ACCESSORY DEVICE

[76] Inventor: Syd Edwards, 1225 Windsor Rd., Cardiff, Calif. 92007

[21] Appl. No.: 915,675

[22] Filed: Jul. 21, 1992

[51] Int. Cl.[5] ..... A45D 1/00

[52] U.S. Cl. ..... 34/97; 132/272; 392/385

[58] Field of Search ..... 34/96, 97, 98, 3, 12, 34/90; 392/379, 380, 382–385; 132/272, 271, 212

[56] References Cited

U.S. PATENT DOCUMENTS 3,745,306 7/1973 Naritomi ..... 34/97
3,947,659 3/1976 Ono ..... 34/97
4,078,525 3/1978 Chiba ..... 392/385
4,114,022 9/1978 Braulke, III ..... 34/97
4,166,473 9/1979 Bauer et al. ..... 392/385
4,523,080 6/1985 Bolton ..... 34/97
4,605,019 8/1986 Reynolds et al. ..... 34/96

*Primary Examiner*—Denise Gromada

[57] ABSTRACT

An accessory device which is releasably mountable on a hair dryer and which contains at least one reservoir for a sprayable material, such as water, hair conditioner, lacquer and the like, and which is actuable by the same hand which holds the hair dryer to apply the sprayable material as desired.

9 Claims, 2 Drawing Sheets

HAIR DRYER ACCESSORY DEVICE

BACKGROUND

1. Field of Invention

This invention relates to hair dryers and is particularly directed to an accessory device which is removably attachable to a hair dryer to facilitate simultaneous hands-free application of a spray able material, such as water, hair conditioner, lacquer, etc. during a drying operation.

2. Prior Art

In the hair dressing art, it is frequently desirable to wash a person's hair and, subsequently, to use a hair dryer to dry the hair. Moreover, in recent years, portable or hand-held hair dryers have been developed and have found wide acceptance, since they allow the hair stylist to comb and style the customer's hair during the drying operation, which makes possible individualized and often highly stylized coiffeurs. However, such individualized styling often requires the application, during the drying operation, of one or more of a variety of sprayable materials, such as water, hair conditioner, lacquer and the like. Unfortunately, the drying operation usually requires that the stylist hold the hair dryer in one hand and use a comb, brush or the like in the other hand. Thus, when the application of these materials is required, the stylist must free one hand in order to pick up and apply the appropriate materials. This has required that the stylist set down either the hair dryer or whatever is in their other hand, which interrupts the styling operation. In fact, such interruptions place significant limitations on the styling techniques which can be employed. Numerous techniques and devices have been proposed heretofore to reduce or eliminate these interruptions and, hence, to provide greater styling flexibility. However, none of the prior art techniques or devices have been entirely satisfactory.

BRIEF SUMMARY AND OBJECTS OF INVENTION

These disadvantages of the prior art are overcome with the present invention and a simple and inexpensive accessory device is provided which is releasably mountable on a hair dryer to enable the stylist to perform simultaneous hands-free application of a sprayable material, such as water, hair conditioner, lacquer, etc. during a drying operation.

The advantages of the present invention are preferably attained by providing an accessory device which is releasably mountable on a hair dryer and which contains at least one reservoir for a sprayable material, such as water, hair conditioner, lacquer and the like, and which is actuable by the same hand which holds the hair dryer to apply the sprayable material as desired.

Accordingly, it is an object of the present invention to provide an improved accessory device for use with portable hair dryers.

Another object of the present invention is to provide an improved accessory device for use with hand-held hair dryers which is simple and inexpensive, yet which facilitate simultaneous hands-free application of a sprayable material, such as water, hair conditioner, lacquer, etc. during a drying operation.

An additional object of the present invention is to provide an improved accessory device for use with hand-held hair dryers which is releasably mountable on the hair dryer to facilitate simultaneous hands-free application of a sprayable material, such as water, hair conditioner, lacquer, etc. during a drying operation.

A specific object of the present invention is to provide an accessory device which is releasably mountable on a hair dryer and which contains at least one reservoir for a sprayable material, such as water, hair conditioner, lacquer and the like, and which is actuable by the same hand which holds the hair dryer to apply the sprayable material as desired.

These and other objects and features of the present invention will be apparent from the following detailed description, taken with reference to the figures of the accompanying drawings.

DETAILED DESCRIPTION OF THE INVENTION

Figure 1:
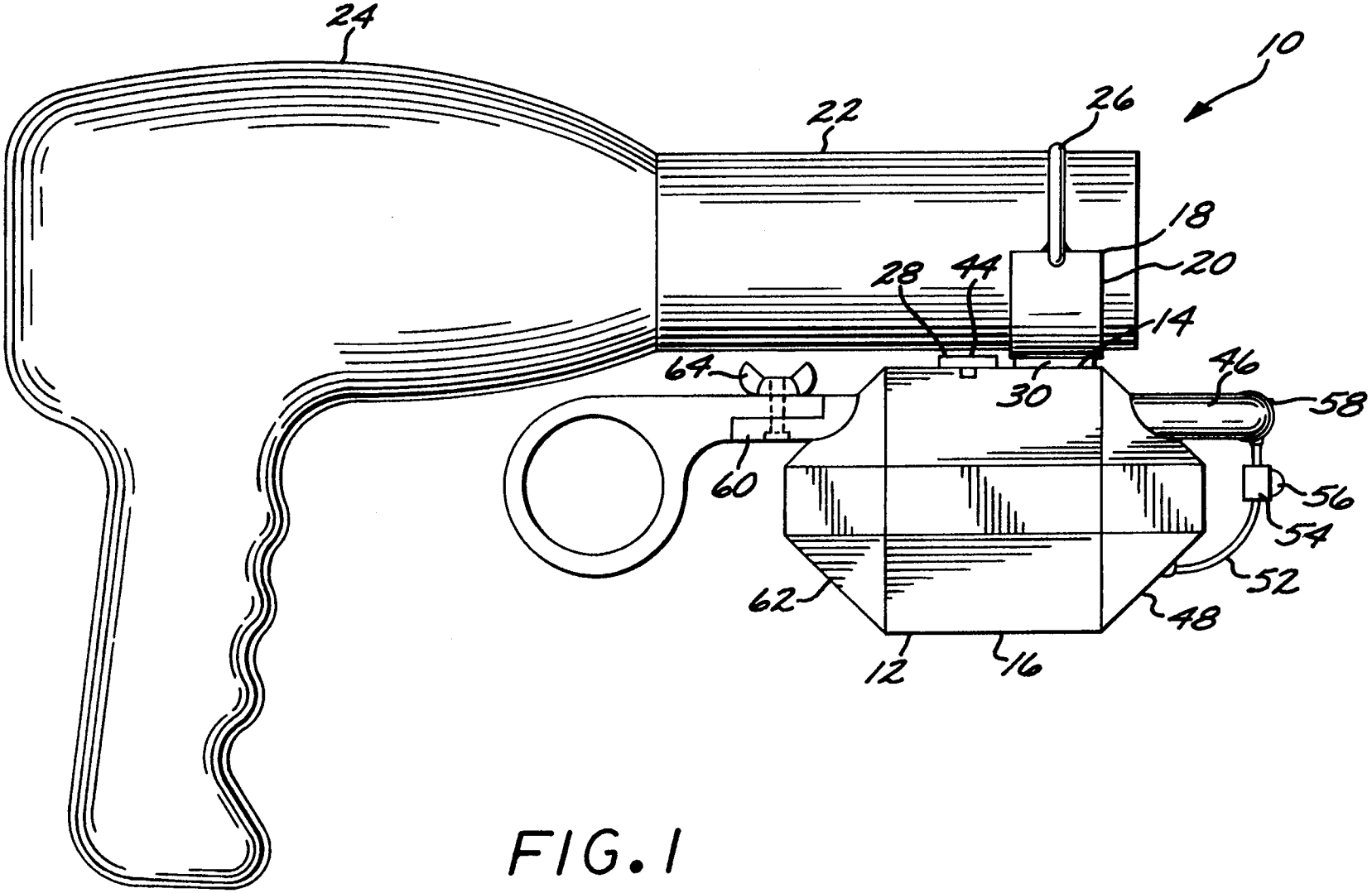
FIG. 1 is a side view of a hair dryer accessory device embodying the present invention.

In that form of the present invention chosen for purposes of illustration in the drawings, FIG. 1 shows an accessory device, indicated generally at 10, having a body member 12 having relatively flat upper and lower surfaces, as seen at 14 and 16, respectively. An attaching member 18 has a base portion 20, shaped to conform generally to the underside of the barrel 22 of a conventional blow drier 24, and has strap means 26 or the like for releaseably attaching the base portion 20 to the barrel 22 of the blow drier 24. The underside of the base portion 20 is provided with attaching means, such as shoe clip 28, which is mateable with suitable flanges 30 provided on the upper surface 14 of the body member 12 to releasably attach the body member 12 to the attaching member 18 and, hence, to the blow drier 24. Preferably, the surface of the body member 12 is formed of or coated with a friction-reducing substance to prevent strands of hair from adhering to the accessory device 10.

Figure 2:
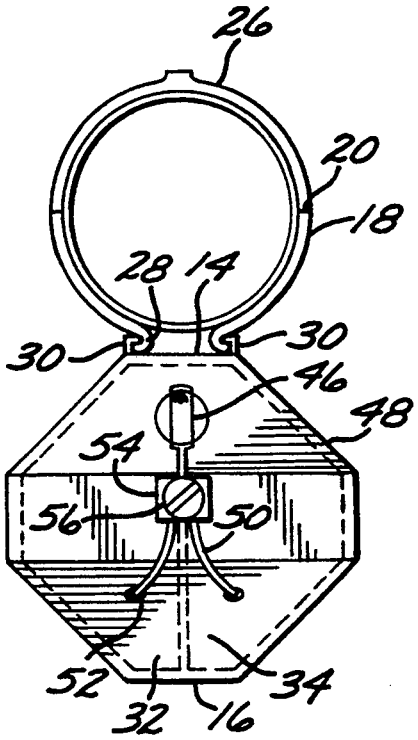
FIG. 2 is a front end view of the accessory device of FIG. 1.
Figure 3:
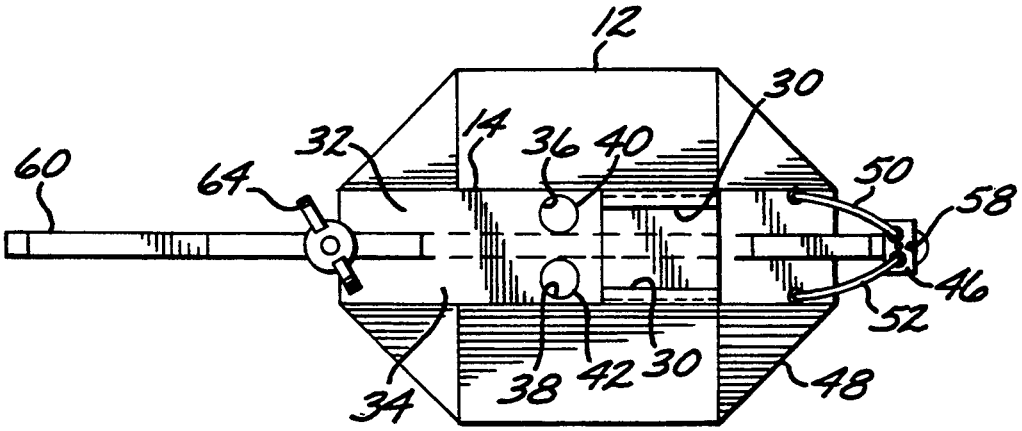
FIG. 3 is a top view of the accessory device of FIG. 1.

The body member 12 is divided into two reservoirs or chambers 32 and 34, as best seen in FIGS. 2 and 3, and each of the reservoirs 32 and 34 is provided with a respective fill opening, as seen at 36 and 38 in FIG. 3, to permit liquids, such as water, hair conditioner, lacquer or the like to be introduced into the respective chambers 32 or 34. Removable caps 49 and 42 are provided to close the openings 36 and 38. As best seen in FIG. 1, the shoe clip 28 preferably has a flange portion 44, projecting rearwardly from the shoe clip 28, which covers the openings 36 and 38, when the body member 12 is attached to the attaching member 18, and which serves to prevent the caps 49 and 42 from becoming displaced during use. A spray nozzle 46 is provided on the front surface 48 of the body member 12 and is connected by suitable tubes 50 and 52 to allow discharge of the liquids from the reservoirs 32 and 34. A Y-valve 54 is connected between the tubes 50 and 52 and the spray nozzle 46 and a selector lever 56 is provided to permit the user to select which of the reservoirs 32 or 34 will supply fluid to be sprayed by the spray nozzle 46. The spray nozzle 46 is provided with an adjustable spout 58 which is movable on the nozzle 46 to adjust the angle of the spray and, hence, the distance at which the spray will enter and interact with the air blast from the blow drier 24. Finally, a trigger arm 60 is provided for actuating the spray nozzle 46. The trigger arm 60 extends through the body member 12 and projects out of the rear surface 62 of the body member 12. As best seen in FIGS. 1 and 3, the trigger arm 60 is adjustable in length and may be secured at a desired length by suitable means, such as wing nut 64.

In use, the removable caps 40 and 42 are removed and the desired liquids are poured through openings 36 or 38 to fill the chambers 32 and 34 within the body member 12. Thereafter, strap 26 of the attaching member 18 is passed about the nozzle 22 of a conventional hand-held hair dryer 24 and is connected to the opposite side of the base portion 20 to releasably attach the attaching member 18 to the nozzle 22 of the blow drier 24. Next, the body member 12 is connected to the attaching member 18 by sliding the shoe clip 28 of the attaching member 18 between the flanges 30 on the upper surface 14 of the body member 12, which serves to attach the body member 12 to the blow drier 24. When this is done, flange 44 of the shoe clip 28 moves to cover the openings 36 and 38 and, hence, prevents the removable caps 40 and 42 from becomind displaced during use. With the accessory device 10 thus loaded and mounted on the nozzle of the hair dryer, the stylist proceeds to style and dry the customer's hair substantially as desired. When it is necessary or desirable to apply one of the liquids stored in the chambers 26 or 28 of the body portion 12, the stylist can select which of the liquids is to be discharged by appropriately positioning the selector lever 56 on the Y-valve 54 and, when desired, can easily release one finger from holding the hair dryer to engage and actuate the trigger arm 60 to cause the spray nozzle 46 to spray the selected liquid, thus, applying the liquid to the customer's hair. It will be apparent that this spraying operation can easily be performed without interrupting or interfering with the drying operation and without requiring the stylist to set down either the hair dryer or comb. Moreover, by adjusting the position of the adjustable spout 58, the operator can selectably vary the distance at which the sprayed liquid enters and interacts with the air blast from the blow drier 24, for example, to control the setting time of the sprayed liquid.

Obviously, numerous variations and modifications can be made without departing from the spirit of the present invention. Therefore, it should be clearly understood that the form of the present invention described above and shown in the figures of the accompanying drawings are illustrative only and are not intended to limit the scope of the present invention.

What is claimed is:

1. A hair dryer accessory device comprising:

a body member removably mountable on said dryer having a body portion formed with at least one reservoir for storing a liquid, flexible strap means for releasably attaching said body member to a barrel of said hair dryer, a spray device mounted on said body member, and trigger means mounted on said body member for actuating said spray device to cause said spray device to discharge said liquid from said reservoir.

2. The device of claim 1 further comprising:

an opening in said body member communicating with said reservoir, cap means for removably covering said opening, and means carried by said strap means for releasably attaching for preventing displacement of said cap means.

3. A hair dryer accessory device comprising:

a body member removably mountable on said dryer having a body portion formed with at least one reservoir for storing a liquid, a spray device mounted on said body member, vertically adjustable spout means for controlling an angle at which liquid is discharged from said spray device, and trigger means mounted on said body member for actuating said spray device to cause said spray device to discharge said liquid from said reservoir.

4. A hair dryer accessory device comprising:

a body member removably mountable on said dryer having a body portion formed with at least one reservoir for storing a liquid, a spray device mounted on said body member, and trigger means mounted on said body member for actuating said spray device to cause said spray device to discharge said liquid from said reservoir, wherein the distance of said trigger means from the spray device is adjustable in horizontal length.

5. A hair dryer accessory device comprising:

a body member removably mountable on said dryer having a body portion, the body portion including therein a first reservoir and a second reservoir for storing liquids, valve means for selectably passing liquid from a desired one of said reservoirs, a spray device mounted on said body member, and trigger means mounted on said body member for actuating said spray device to cause said spray device to discharge liquid from one of said reservoirs.

6. The device of claim 1 further comprising:

said body portion having a flat bottom to enable said device to be free-standing when not attached to said hair dryer.

7. The device of claim 3 further comprising said body portion having a flat bottom to enable said device to be free-standing when not attached to said hair dryer.

8. The device of claim 4 further comprising said body portion having a flat bottom to enable said device to be free-standing when not attached to said hair dryer.

9. The device of claim 5 further comprising said body portion having a flat bottom to enable said device to be free-standing when not attached to said hair dryer.

* * * * *